United States Patent [19]

Endo et al.

[11] Patent Number: 4,658,119

[45] Date of Patent: Apr. 14, 1987

[54] WARMING APPARATUS FOR USE DURING SLEEP

[75] Inventors: Shinichi Endo; Hideho Shinoda, both of Yamatokoriyama; Kunio Kimata, Kyoto, all of Japan

[73] Assignee: Matsushita Electric Industrial Co., Ltd., Osaka, Japan

[21] Appl. No.: 739,908

[22] Filed: May 31, 1985

[30] Foreign Application Priority Data

Jun. 6, 1984 [JP] Japan ..... 59-115988

[51] Int. Cl.[4] ..... H05B 1/02

[52] U.S. Cl. ..... 219/492; 219/212; 219/493; 219/505

[58] Field of Search ..... 219/212, 489, 492, 493, 219/508, 505

[56] References Cited

U.S. PATENT DOCUMENTS 2,794,896 6/1957 Huck ..... 219/212

4,277,670 7/1981 Mori et al. ..... 219/212 X 4,430,560 2/1984 Mills et al. ..... 219/508 X

*Primary Examiner*—John Sipos

*Assistant Examiner*—Steven P. Weihrouch

*Attorney, Agent, or Firm*—Stevens, Davis, Miller & Mosher

[57] ABSTRACT

A warming apparatus for use during sleep includes at least one of a temperature-up timer circuit for raising a temperature of an electric heater by an amount in the range of 2° C. to 6° C. for a predetermined time and thereafter restoring the temperature of the electric heater to a preset ordinary temperature, and a temperature-dowm timer circuit for lowering the temperature of the electric heater by an amount in the range of 2° C. to 6° C. for a predetermined time and thereafter restoring the temperature of the electric heater to the preset ordinary temperature, each of the temperature-up timer circuit and the temperature-down timer circuit being actuated while the warming apparatus is in operation.

4 Claims, 3 Drawing Figures

WARMING APPARATUS FOR USE DURING SLEEP

BACKGROUND OF THE INVENTION

1. Field of the Invention

The present invention relates to a warming apparatus for use during sleep and more particularly to such a warming apparatus which is constructed to allow easy temperature adjustment while the warming apparatus is in operation.

2. Description of the Prior Art

Description will be made of an electric blanket by way of an example of a conventional warming apparatus for use during sleep. When a person goes to sleep, they use an electric blanket by setting an adjusting dial or temperature setting means to a high temperature setting for about 1 hour for preheating the bed, and then, after the bed has been warmed sufficiently, changing the setting of the adjusting dial or the temperature setting means to a lower setting which provides an appropriate lower temperature. Now, it is frequently the case, particularly with a person who feels chilly and unsatisfied with the present dial setting, to reset the adjusting dial to a high dial setting to raise the temperature of the blanket to warm their body rapidly. When such a high dial setting is selected, however, it is necessary for them to keep awake until their body has been warmed and then to restore the dial setting to a proper temperature setting after the lapse of a suitable time period. In most cases, however, the person falls asleep leaving the high dial setting as it is, and the dial setting is lowered only after they are awakened by an excessively high temperature. This is extremely unpleasant for a sleeper who desires to have a comfortable sleep.

To correct this problem, one can use a so-called "high" start method. According to this method, when a "high" start switch disposed in a controller of an electric blanket is closed, even if the dial setting remains at a normal setting suitable for sleeping, the blanket temperature is once raised to a "high" temperature and then the blanket temperature is automatically lowered to the temperature corresponding to the preset dial setting, thereby facilitating a dial operation for the purpose of preheating. It may be considered to use this "high" start switch method for recovering the temperature of a sleeper's body which has been lowered by leaving their bed. However, the use of this method has a disadvantage in that once the blanket temperature is raised to the "high" temperature the sleeper is exposed to a high bed temperature for a time. On the other hand, when the room temperature is high or when the body of a person has been warmed sufficiently because of drinking, bathing or the like, they often feel that the bed preheated by the electric blanket is too hot, and in this case will adjust the dial setting to a lower setting before going to sleep. Therefore, at dawn they will be awakened by the cold and will have to readjust the dial setting. Also, there is a further disadvantage. Since it is difficult for an aged person to read letters on a dial without using glasses, they are obliged to adjust the dial setting only by feel and hence there may result an excessively high or low dial setting, thereby making it difficult to have an appropriate bed temperature.

SUMMARY OF THE INVENTION

The present invention has been made with a view to overcoming the foregoing deficiencies in the prior art.

It is therefore an object of the present invention to provide a warming apparatus for use during sleep such as an electric blanket, etc., in which the temperature of an electric heater is raised or lowered departing from a comfortable temperature preset by temperature setting means for some time, as occasion demands, while the warming apparatus is in operation, and thereafter is automatically restored to the initial comfortable temperature thereby allowing a sleeper to obtain a warming apparatus which is easily operable and to enjoy a comfortable sleep.

To accomplish this object, in accordance with the present invention, there is provided a warming apparatus for use during sleep in which a control circuit for controlling an electric current flow through an electric heater comprises at least one of a temperature-up timer and a temperature-down timer circuit, each of which can be actuated while the warming apparatus is in operation the former temperature-up timer circuit raising the temperature of the electric heater above a preset temperature preset by the temperature setting means for a predetermined time period and thereafter restoring it to the preset temperature, and the latter temperature-down timer circuit lowering the temperature of the electric heater below the preset temperature preset by the temperature setting means for a predetermined time period and thereafter restoring it to the preset temperature.

DESCRIPTION OF THE PREFERRED EMBODIMENTS

An embodiment of the present invention will now be described taking an electric blanket as an example of the warming apparatus of this invention and with reference to the accompanying drawings.

Figure 1:
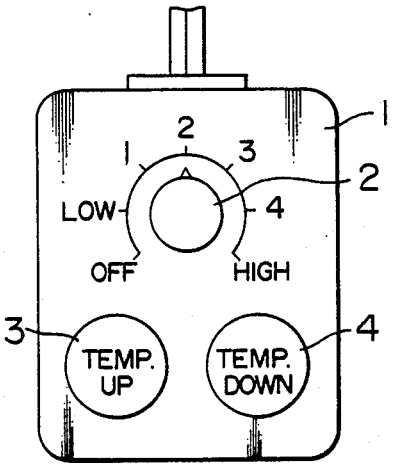
FIG. 1 is a schematic front view showing a controller of a warming apparatus for use during sleep according to an embodiment of the present invention.

FIG. 1 shows a controller of an electric blanket. In the figure, numeral 1 designates a controller case. Numeral 2 designates a dial functioning as a temperature setting means for adjusting the temperature of an electric heat-sensitive heater 48 in FIG. 3, and the dial 2 is operated interlinked with a variable resistor (35 in FIG. 3) incorporating an ON-OFF switch and disposed in the controller. By adjusting the setting of the dial 2, it is possible to preset the temperature of the electric heat-sensitive heater 48 to any temperature in the range between the room temperature and about 55° C. Numeral 3 designates a push button of a temperature-up switch, and 4 a push button of a temperature-down switch. By pressing the push button 3 or 4, it is possible to operate the temperature-up timer circuit or the temperature-down timer circuit disposed in the controller case 1, perspectively, and thereby to obtain, for a predetermined time period, a temperature which is higher or lower than the temperature preset by the dial 2 by a predetermined value.

Figure 2:
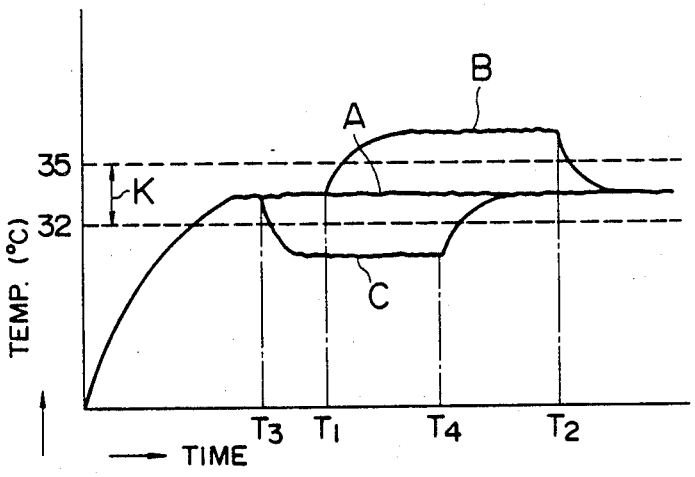
FIG. 2 is a temperature characteristic diagram of the warming apparatus for use during sleep shown in FIG. 1.

FIG. 2 is a graph showing the transition of a bed temperature. In the figure, a curve A shows the transition of the bed temperature when the sleeper is asleep ordinarily. The operating portion of the curve A falls within a comfortable temperature zone K of about 32° to 35° C. where the human body usually feels comfortable. A curve B shows a state of the transition of the bed temperature where, since a person feels chilly after they have woken up and left the bed and returned at a time $T_1$, they have pressed the push button 3 of the temperature-up switch and gone to sleep, whereby the temperature of the electric blanket rises so that the bed temperature exceeds the comfortable temperature zone K to warm his body rapidly and then the timer completes its operation at a time $T_2$, so that the bed temperature is restored to the preset temperature. On the other hand, a curve C shows a state of the transition of the bed temperature where a person, whose body has been warmed sufficiently by bathing, drinking or the like, goes to bed at a time $T_3$, and, since the temperature of the electric blanket is left to be uncomfortably high, the person goes to sleep after pressing the push button 4 of the temperature-down switch to lower the temperature of the electric blanket and to cause appropriate dissipation of the heat in the electric blanket, and thereafter the timer completes its operation at a time $T_4$ and the temperature setting is restored to the original dial setting which provides the initial ordinary comfortable temperature.

The performance shown by the curve B may be utilized by pressing the push button 3 of the temperature-up switch before a person rises in the morning so as to raise the temperature of the electric blanket for some time, thereby warming the body sufficiently.

Figure 3:
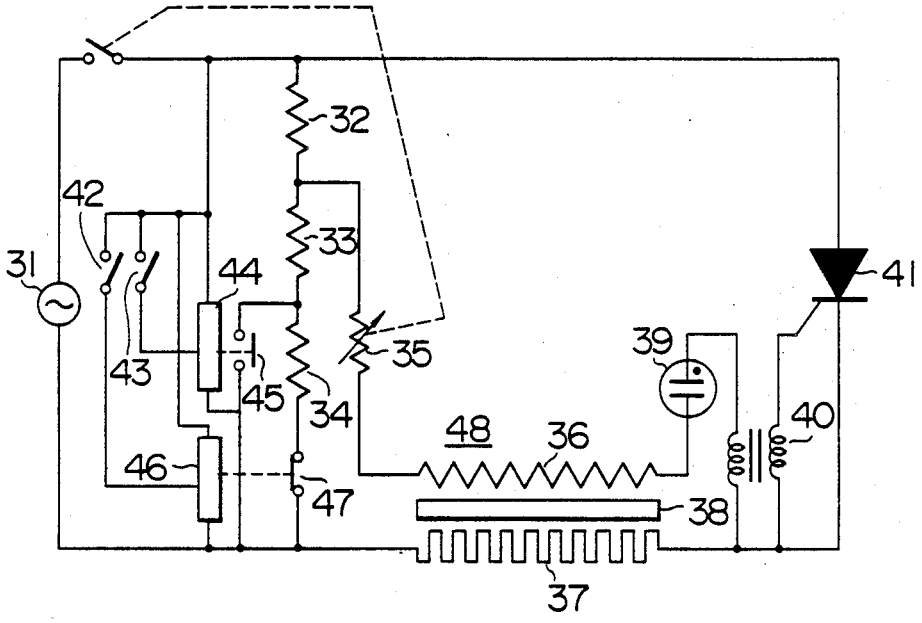
FIG. 3 is an electric circuit diagram of the control circuit used in the warming apparatus for use during sleep shown in FIG. 1.

FIG. 3 shows a control circuit including the temperature-up and temperature-down timer circuits used in the embodiment of this invention.

In the Figure, numeral 31 designates a power source, 32, 33 and 34 resistors, and 35 the temperature adjusting variable resistor operable interlinked with the dial 2 shown in FIG. 1. Numeral 48 designates a heat-sensitive heater of known construction wherein a heater wire 37 is wound around a core string, the coating of a temperature sensor (plastic thermistor) layer 38 of the negative impedance versus temperature characteristics is applied thereon, a signal wire 36 is wound thereon, and further an outer covering is applied thereon. The heat-sensitive heater 48 is fixed in the electric blanket with a predetermined pattern. Numeral 39 designates a pulse generator, 40 a pulse transformer, and 41 a thyristor. Numeral 42 designates a reset switch of the temperature-up timer circuit 46. When the push button 3 is pressed, the reset switch 42 is temporarily closed to start the temperature-up timer circuit 46, whereby a contact 47 of the temperature-rise switch is opened for a predetermined time to raise the temperature of the heat-sensitive heater 48 and thereby to raise the temperature of the electric blanket. Numeral 43 designates a reset switch of the temperature-down timer circuit 44. When the push button 4 is pressed, the reset switch 43 is temporarily closed to start the temperature-down timer circuit 44, whereby a contact 45 of the temperature-down switch is closed for a predetermined time to lower the temperature of the heat-sensitive heater 48 and thereby to lower the temperature of the electric blanket.

The operation of the control circuit will be described hereinafter. When the reset switches 42 and 43 are not operated, the power supply voltage is divided by a series circuit of the resistors 32, 33 and 34, and a voltage at the junction between the resistors 32 and 33, which is designated here as $A_1V$ and is lower than the power supply voltage by a voltage drop xV across the resistor 32, is in turn divided by the variable resistor 35 and the impedance of the temperature sensor 38, and the resulting voltage is applied to the pulse generator 39 connected between the signal wire 36 and the heater wire 37. When the temperature is low, the impedance of the temperature sensor 38 becomes high, and the voltage between the signal wire 36 and the heater wire 37 increases thereby to turn the pulse generator 39 conductive. Thus, a pulse signal is applied to the gate of the thyristor 41 through the pulse transformer 40 so that the thyristor 41 is turned on, thereby causing the heater wire 37 to be heated and thus the temperature of the heat-sensitive heater 48 to rise. When the temperature of the heat-sensitive heater 48 rises, the impedance of the temperature sensor 38 becomes low, and therefore the voltage drop thereacross decreases thereby to turn the pulse generator 39 nonconductive. Thus, the thyristor 41 remains in the nonconductive state, thereby causing the heater wire 37 to stop heating and thus the temperature of the heat-sensitive heater 48 to fall. By repeating the above-described operation, the temperature of the heat-sensitive heater 48 is regulated at a constant temperature determined by the resistance value of the variable resistor 35. While in the illustration of FIG. 3, the heater wire 37 and the temperature sensor 38 are incorporated into an integral unit, the same temperature control can be effected even if the heater wire 37 and the temperature sensor 38 are disposed separately.

Then, when the reset switch 42 of the temperature-up timer circuit 46 has been closed once, the temperature-up timer circuit 46 is reset to maintain the contact 47 of the temperature-up switch opened and hence the series circuit of the resistors 33 and 34 opened for a given time which is preset by the timer. Accordingly, the voltage $A_1V$ is raised by the value of xV. As a result, when the impedance of the temperature sensor 38 decreases by an impedance value corresponding to the value of xV which is to be caused by a rise in the temperature of the temperature sensor 38, the pulse generator 39 turns nonconductive and therefore the energization of the heat-sensitive heater 48 stops, thereby making it possible to regulate the blanket temperature at an elevated temperature. On the other hand, when the reset switch 43 of the temperature-down timer circuit 44 is closed, the temperature-drop timer circuit 44 is reset to maintain the contact 45 of the temperature-down switch closed and hence the resistor 34 short-circuited for a given time which is preset by the timer. Consequently, the voltage $A_1V$ is decreased by a magnitude corresponding to a voltage drop yV across the resistor 34. Thus, the temperature control can be effected so as to maintain the temperature of the blanket at a lower temperature contrary to the above-described case where the reset switch 42 of the temperature-up timer circuit 46 is closed. Each of the reset switches 42 and 43 is of the type whereby contact is made only when the push button 3 or 4 is depressed and contact is broken when the push button 3 or 4 is released, respectively.

A desired amount of up or down change in the blanket temperature caused by the operation of the temperature-up switch or the temperature-down switch should preferably be selected to be about 2° to 6° C. The reason therefor is that a comfortable temperature range for a sleeper in the bed is relatively as narrow as 32° to 35° C.

and the sleeper feels hot or cold outside this temperature range, so that it is unnecessary to provide any temperature change exceeding the above-mentioned temperature range. In this connection, if the amount of this temporary temperature change is increased, that is, for example, if a temperature value reached by the temporary temperature increase is selected to be equal to the high temperature setting or a temperature value reached by the temporary temperature decrease is selected to be below 20° C., the sleeper feels heavy discomfort when the timer fails and it can not restore the blanket temperature to the preset temperature value, and also the sleeper feels excessive heat or coldness to a greater extent when the body is less chilly or hot.

In the apparatus of the present invention, when a sleeper's body is chilly or hot, simply by pressing the push button 3 of the temperature-up switch or the push button 4 of the temperature-down switch, as desired, the sleeper can maintain the blanket temperature first at an elevated or lowered temperature, respectively, for a predetermined time and then to return it to an ordinary preset temperature, so that it is possible for the sleeper to go sleep without waiting until the body gets warm or cold. Thus, the sleeper is allowed to enjoy a comfortable feeling by the use of the apparatus of this invention.

Further, in the above-described embodiment of the present invention, since it is easy to make the respective push buttons of the temperature-up switch and temperature-down switch of a large size whereby they can be operated only with a simple pressing operation, there is no necessity for a sleeper to operate the push buttons while looking at any small letters on the dial with sleepy eyes, and especially a farsighted person is free of the difficulty of having to wear glasses when looking at the letters on the dial, thereby preventing any possibility of operating the dial by guesswork relying only on the feel of his finger tips but with no visual confirmation.

Further, it is possible to leave the dial setting at a preset ordinary temperature setting, without adjusting the dial to another setting slightly higher or lower than a preset ordinary temperature depending on the temperature of the day, and to go to sleep maintaining the temperature of the warming apparatus for use during sleep at a higher or lower value for a predetermined time simply by operating either one of the push buttons 3 and 4 of the temperature-up switch and temperature-down switch, respectively, as desired.

From the foregoing description, it will be apparent that the present invention has an excellent advantage of providing a warming apparatus for use during sleep which is constructed to be very easy to operate and which is adapted to allow a sleeper to enjoy comfortable sleep.

We claim:

1. A warming apparatus for use during sleep comprising:

an electric heater;

temperature setting means for presetting a temperature of said electric heater; and a control circuit for controlling an electric current flow through said electric heater to maintain the temperature of said electric heater at the temperature preset by said temperature setting means, said control circuit including a temperature-down timer circuit and means to actuate said timer circuit while said warming apparatus is in operation, to cause the temperature of said electric heater to become lower than the temperature preset by said temperature setting means by an amount in the range from 2° C. to 6° C. for a predetermined time period and thereafter restoring the temperature of said electric heater to the preset temperature.

2. A warming apparatus according to claim 1, further comprising a push button switch for actuating said temperature-down timer circuit.

3. A warming apparatus for use during sleep comprising:

an electric heater;

temperature setting means for presetting a temperature of said electric heater; and a control circuit for controlling an electric current flow through said electric heater to maintain the temperature of said electric heater at the temperature preset by said temperature setting means, said control circuit including a temperature-up timer circuit and means to actuate said timer circuit while said warming apparatus is in operation, to cause the temperature of said electric heater to become higher than the temperature preset by said temperature setting means by an amount in the range from 2° C. to 6° C. for a predetermined time period and thereafter restoring the temperature of said electric heater to the preset temperature.

4. A warming apparatus according to claim 3, further comprising a push button switch for actuating said temperature-up timer circuit.

* * * * *